United States Patent [19]

Chappell

[11] Patent Number: 4,582,300

[45] Date of Patent: Apr. 15, 1986

[54] FENCE SUPPORT STRUCTURE

[76] Inventor: Derrald H. Chappell, 495 E., Chalk Creek Rd., Box 23, Coalville, Utah 84017

[21] Appl. No.: 525,237

[22] Filed: Aug. 22, 1983

[51] Int. Cl.[4] ..... B21F 27/00; E04H 17/02

[52] U.S. Cl. ..... 256/36; 256/31; 160/374

[58] Field of Search ..... 256/35, 36, 73, 29, 256/30, 31; 160/374

[56] References Cited

U.S. PATENT DOCUMENTS

| | | | |
|---|---|---|---|
| 247,493 | 9/1881 | Gates | 256/29 |
| 253,520 | 2/1882 | DuBois | 160/374 |
| 553,662 | 1/1896 | White | 256/73 |
| 566,408 | 8/1896 | Neil | 256/43 |
| 656,390 | 8/1900 | Condon | 256/73 |
| 1,235,021 | 7/1917 | Follmer | 256/31 |
| 1,244,623 | 10/1917 | McClees | 256/31 |
| 1,553,321 | 4/1925 | Lanott | 256/35 |
| 2,330,017 | 9/1943 | Taylor | 189/31.4 |
| 2,445,545 | 7/1948 | Verner | 256/35 |
| 3,423,072 | 1/1969 | Bernstein | 256/24 |
| 3,815,877 | 6/1974 | Turner | 256/24 |
| 4,073,478 | 2/1978 | Bermudez | 256/24 |
| 4,174,096 | 11/1979 | Campbell | 256/24 |
| 4,422,622 | 12/1983 | Broski, Jr. | 256/73 X |
| 4,465,262 | 8/1984 | Itri et al. | 256/73 X |

*Primary Examiner*—Andrew V. Kundrat

*Attorney, Agent, or Firm*—Workman, Nydegger & Jensen

[57] ABSTRACT

A fence support structure for distributing stress forces between fence posts in a fence line. The support structure includes a fence panel having at least one vertical member and at least one structural member attached to the vertical member for transferring the stress forces to other fence posts, the fence panel is disposed substantially in the fence line between a first and a second fence post. The vertical member is secured adjacent the first post by conventional securing means, and the outward end of the structural member is secured adjacent the second fence post. The fence panel may be of unitary construction or it may be comprised of separate, substantially linear components which may be assembled in the field and which may be interconnected by use of slip joints or nut and bolt assemblies. Optionally, some or all of the components may be slidably adjustable in length so as to permit adjustment of the length of the fence panel. Support structures may be included in the fence panel which permit its use as a step or ladder permitting one to cross the fence without damaging the integrity of the fence structure.

38 Claims, 15 Drawing Figures

FENCE SUPPORT STRUCTURE

This invention relates generally to fences, and more particularly to structures used to support the stress posts in a fence.

BACKGROUND OF THE INVENTION

Throughout history, fences have been used to mark property boundaries, to ward off enemies, to keep livestock either in or out, for landscaping, for decorative purposes, for crowd control, and for many other purposes. Early fences generally comprised walls formed by stones stacked upon stones or wood stacked upon wood. Usually the inhabitants of an area used whatever resources were plentiful in the area whether it was stones, logs, sticks and twigs, mud, or soil and grass.

The construction of early fences was a time-consuming and laborious task. Frequently, the fences or walls constructed to protect a community would take many years and countless workers to complete. Thus, the use of fences or walls was typically confined to small areas of land. For example, a single farmer did not have the time or manpower to enclose vast amounts of land within elaborate stone or wooden fences or walls.

However, with the advent of the wire fence, both barbed and meshed, vast expanses of land could be enclosed within the fence in much less time and with considerably less manpower. Large areas of the range were staked out and fenced off to prevent livestock from intruding or escaping.

In the time since the wire fence was first used, there have been a number of improvements to fencing. We now have chain link fencing which is used both privately and commercially for security and privacy purposes. We have fences made from newly developed lightweight steel or aluminum. We now have prefabricated fencing and fencing that is constructed from modular components. Each of these types of fencing has its specific uses, advantages and disadvantages. For example, it would be impractical to use a chain link fence to enclose ranches with range land stretching over several miles and thousands of acres. Also, it would be impractical to use a low modular crowd control fence to fence in a herd of livestock. Further, it would be considered anti-social to use a barbed wire fence to enclose a small yard in a suburban residential area where no livestock is kept.

The wire fence has some very salient advantages and some equally notable disadvantages. Wire fences, particularly barbed wire fences, can be constructed rather quickly and can span long distances. Because of these advantages, wire fences are particularly suitable for range use. Such fences can be constructed in remote areas which are not accessible by road because the materials needed to construct the fence can be transported by horseback (e.g., wire strands and metal posts) or can be harvested from the area (e.g., cedar posts). In recent years, metal posts have become very popular because they have streamlined fence construction. One does not have to dig post holes or cut cedar posts. All that is needed is to drive the post into the soil and string the wire from post to post.

Despite the advances in wire fencing, there have always been certain problems which have arisen. Such fencing is frequently in need of repair and such repairs may be in locations remote from road or river access. A needed repair may be occasioned because the cattle lean against the fence bending or breaking the posts or stretching the wire. Also, in an area where man frequently climbs over the fence, the same difficulties may arise. Further, if wood posts are used, after a time they might develop ground rot and break under the stress of the taut wire.

One of the primary causes of fence failure is the stress placed on stress posts in a wire fence. A stress post may be a corner post which has wire pulling at it from two or more directions, or a post at the crest of a hill or at the bottom of a valley where the wire does not pull against the post at a substantially perpendicular angle. A stress post may also be a gate post which not only bears the stress of the tautly pulled wire but may also bear the weight of a swinging gate. There is often a great amount of stress placed on these stress posts, and thus it is not uncommon to see an entire fence line toppled to the ground because the stress post has broken off or bent over under the forces exerted upon it.

To reduce fence failure at these critical points of stress, it is necessary to brace or support the stress post to distribute the forces to more than one post or even to direct the forces into support from the ground. In the past, such bracing support has usually been bracing structure constructed on site from materials available in the area. This is extremely time consuming and requires adequate materials.

In recent years, metal support structures have been introduced, but the configurations used have not been entirely satisfactory. Frequently, they comprise many parts which must be assembled on site using several tools and more than one person. Also, this type of bracing may require that bracing members be anchored or cemented into the ground. This requires that additional materials (such as concrete) be carried to the site. Also, the configurations used frequently require that the support structure be placed outside the line of the fence and possibly onto a neighbor's property.

Another problem encountered in attempting to provide support structures for a fence is that the spacing between fence posts is often quite non-uniform. Thus, the post bracing devices have typically not extended between positions adjacent to fence posts, but rather they transmit the stress to ground. If a brace has connected two fence posts, it has most likely been constructed on-site and is not pre-fabricated or standard in configuration and size. In light of the deviations in post spacing, in the past it has simply not been feasible to produce prefabricated or standard sized fence supports which were designed to extend between fence posts and distribute stress forces. The fence support structure of this invention is designed to provide support to a fence; to be modular and yet useable on fences with non-uniform post spacing; reduce the problems now encountered in constructing bracing supports; and to overcome the inadequacies of the presently used supports.

BRIEF SUMMARY AND OBJECTS OF THE INVENTION

The present invention comprises a novel device and method for distributing stress forces between fence posts in order to provide support for the posts. The device comprises a modular fence panel which includes at least one vertical member having one or more structural support members extending outwardly therefrom. The fence panel is secured along the vertical member adjacent a first fence post which may be a stress post, and at the outward end of the structural support members adjacent a second fence post. Preferably, the fence panel is disposed substantially within or parallel to the line of the fence in which the above-mentioned fence posts are positioned, and requires no angular support guide wires or anchoring materials such as cement.

Optionally, the modular fence panel can include at least one additional vertical member, which is secured to the outer ends of the structural support members and serves as the anchoring means for interconnecting the first and second fence posts. The modular fence panel can be prefabricated to form a unitary panel by use of welded or precast metallic members, or it can be constructed so as to comprise several substantially linear and lightweight component parts for easy carrying which may be assembled in the field using slip joints or by a simple nut and bolt assembly. The fence panel can also be configured to include support structure defining steps or a ladder which permits climbing over the fence without destroying the integrity of the fence.

In each case, several fence panels can be used in series along the fence line to further distribute the stress among the various interconnected fence posts. The fence panel is secured in position adjacent the fence posts by conventional fastening methods such as clamps or wires.

Accordingly, it is an object of this invention to provide a fence support structure which is easy and quick to install in a fence line.

Another object of this invention is to provide a fence support structure which is modular and can be used with any type of fence post whether it be metal or wood.

A further object of the present invention is to provide a fence support structure which is modular and can be retrofit to an existing fence to provide support.

Still another object of the present invention is to provide a fence support structure which is lightweight and can be carried easily on horseback to areas remote from normal transportation thoroughfares.

Another object of the present invention is to provide a fence support structure which is disposed substantially in the fence line and requires no angular support guide wires or any additional anchoring materials such as cement.

A further object of the present invention is to provide a fence support structure which can be used to support a number of different types of stress posts such as corner posts, gate posts, the post at the crest of a hill or the post at the bottom of a valley.

Still another object of the present invention is to provide a fence support structure that can be secured into the fence line using conventional fastening methods such as clamps or wires.

Another object of the present invention is to provide an embodiment of a fence support structure which is comprised of a plurality of substantially linear component parts which are easily assembled using slip joints or a simple nut and bolt assembly.

A further object of the present invention is to provide a fence support structure which can be prefabricated and then easily carried into the field for use.

Still another object of the present invention is to provide a fence support structure having a step which permits climbing over the fence without destroying the integrity of the fence.

Another object of the present invention is to provide a fence support structure which can be used in cooperation with additional such structures to further distribute stress from stress posts to other fence posts.

Still a further object of the present invention is to provide a fence support structure which is expandable in size so that it may be utilized in retrofitting existing fences or in new fences wherein the spacing distances between fence posts are not uniform or exact to a particular specification.

These and other objects and features of the present invention will become more fully apparent from the following description and appended claims taken in conjunction with the accompanying drawings.

DETAILED DESCRIPTION OF THE PREFERRED EMBODIMENTS

Reference is now made to the drawings wherein like parts are designated with like numerals throughout.

Figure 1:
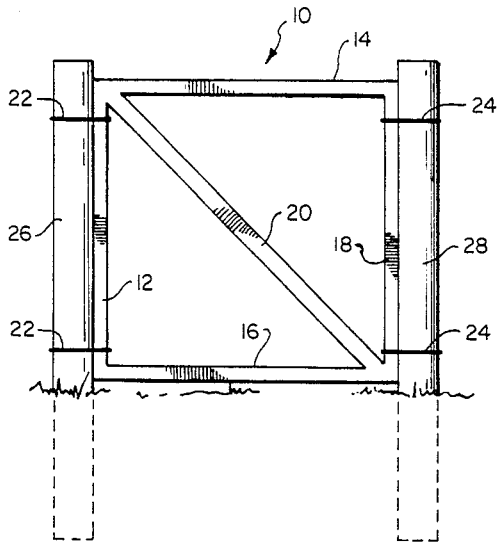
FIG. 1 is a front elevational view of one presently preferred embodiment of the fence support structure of the present invention.

FIG. 1 illustrates one preferred embodiment of the modular fence panel generally indicated at 10 which may be utilized as a means for distributing stress loading between a stress post and another fence post. Fence panel 10 includes a first vertical member 12 which has a top horizontal member 14 and bottom horizontal member 16 extending outwardly from positions adjacent the upper and lower ends, respectively, of vertical member 12.

The outer ends of horizontal members 14 and 16 are secured to the top and bottom portion, respectively, of a second vertical member 18. A cross piece 20 extends diagonally across fence panel 10 in order to further assist in the transfer of stress forces. The modular fence panel 10 is secured adjacent to one or more fence posts by means of conventional fastening methods such as clamps or wires 22 and 24.

Clamps or wires 22 and 24 are secured about adjacent fence posts 26 and 28, in a manner sufficient to bring the vertical members 12 and 18 into position adjacent to, and in physical contact with, the fence posts 26 and 28. Typically, at least one of the fence posts 26 and 28 will be what is often referred to in the art as a stress post. Among other things, stress posts typically comprise corner posts, gate posts, end posts, and posts positioned at the top of rises, or in the bottom of depressions. Even though the posts 26 and 28 are secured at least partially within the earth, they still tend to bend or break over an extended period of time in response to the continuous stress forces experienced by the stress post. By use of the modular fence panel 10, a means is provided for transferring some of the stress from a stress point (for example, post 26) onto an adjacent fence post 28. In addition, the vertical member positioned adjacent the stress post not only serves as a good connection or anchor member, but also serves to reinforce and further strengthen the stress post to which it is connected.

The modular fence panel may be constructed in a unitary fashion by pre-welding or casting metallic components to form the support structure before it is actually utilized in the fence. In one preferred embodiment, aluminum is used because of its weight, which permits ease in carrying of the fence panel by hand or on horseback.

The modular fence panel 10 may optionally be comprised of several substantially linear component parts which are easily assembled using slip joints or simple nut and bolt assemblies. The components are configured so as to provide for ease in handling and transport, while also permitting ready assembly in the field by use of simple slip joints, or by use of nut and bolt assemblies. Particular examples of such embodiments will be described in more detail hereinafter.

Figure 2:
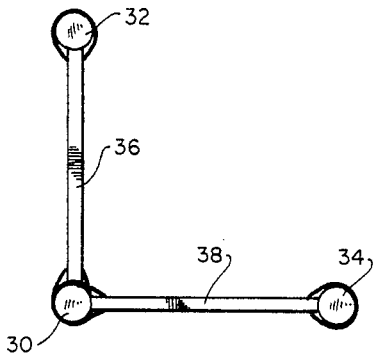
FIG. 2 is a top plan view of another preferred embodiment of the fence support structure, illustrating the invention as used for supporting a corner fence post.

By reference to FIG. 2, another preferred embodiment of the fence support structure is illustrated as it may be utilized in conjunction with the support of a corner post. In particular, corner post 30 comprises a corner defined by the intersection of a fence line running in the direction of post 32, and another fence line running in the direction of post 34. In this situation, a first modular fence panel is secured in position between posts 30 and 32 so as to distribute stress from post 30 across the fence panel 36 and to fence post 32. In addition, a second modular fence panel 38 is positioned so as to transfer stress forces from post 30 through fence panel 38 to fence post 34.

It is noted that the modular fence panels disclosed herein provide a means for supporting the stress post while also being disposed substantially in the fence line so as to require no angular support guide wires nor any other additional anchoring materials.

Figure 3:
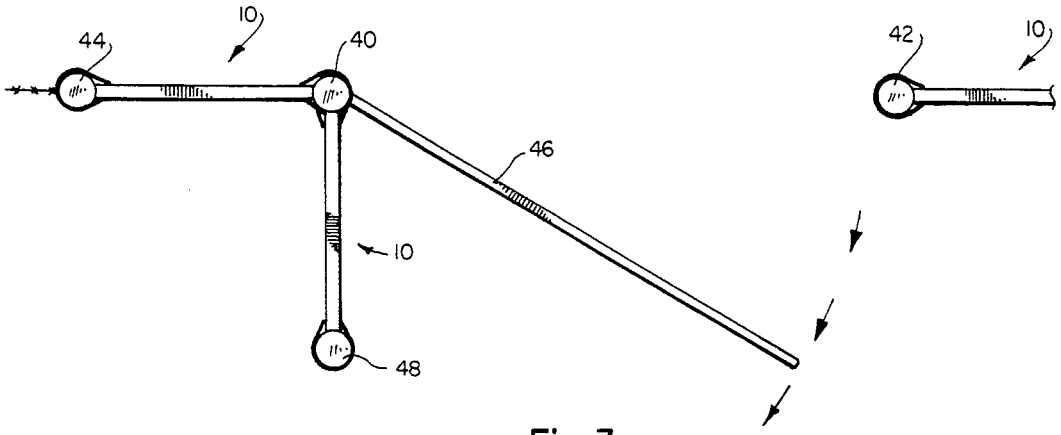
FIG. 3 is a top plan view of another preferred embodiment of the present invention, illustrating use of the fence support structure for supporting a gate post.

Referring now to FIG. 3, the use of the fence support structure in conjunction with support of gate posts may be described. In a swinging gate situation, a hinge post 40 and a latch post 42 both become subject to stresses, since they are each connected to the fence line on only one side. With respect to the hinge post 40, stresses not only come from the direction of the fence line as transmitted through fence post 44, but they are also transmitted to the hinge post 40 from swinging gate panel 46. Since panel 46 is only supported by hinge post 40, the stresses from the gate panel 46 are directly transmitted to hinge post 40, and their resultant effect on post 40 varies depending upon the positioning of panel 46. Therefore, it becomes advisable to support hinge post 40 not only with respect to forces transmitted from the direction of the fence line, but also to provide supplemental support from a direction outside the fence line. For this purpose, a support post 48 may be provided in a position outside of alignment with the fence line, with the actual location of post 48 being that which will permit maximum support of hinge post 40, while not interfacing with the desired swing arc of the gate panel 46. Of course, since support post 48 may be positioned at substantially any location about hinge post 40, other factors such as positioning the post on one's own property, or positioning it for other uses such as a hitching rack, may also play a part in determining its position.

With the posts properly located, support is provided for hinge post 40 by positioning a first modular fence panel 10 between hinge post 40 and fence post 44, and positioning a second modular fence panel 10 between hinge post 40 and support post 48. The modular fence panels are secured in position in the manner previously described with respect to FIGS. 1 and 2.

Support for latch post 42 is also provided by use of a modular fence panel 10 which is positioned between post latch 42 and its next adjacent fence post (not shown) in the fence line. Again, the modular fence panel used for supporting latch post 42 is secured to that post and the next adjacent post in the manner described with respect to FIGS. 1 and 2 above.

Figure 4:
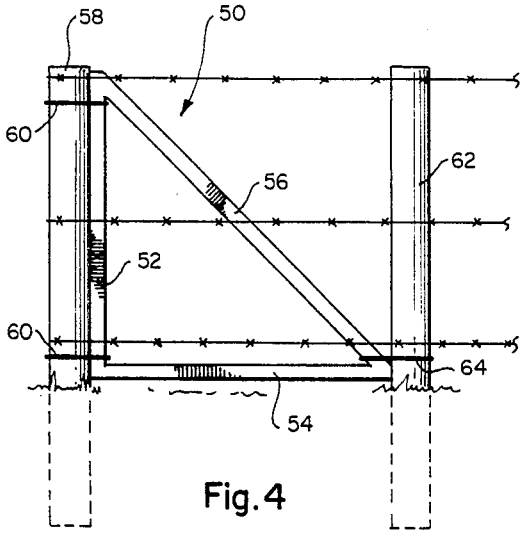
FIG. 4 is a front elevational view of another preferred embodiment of the present invention, illustrating the fence support structure in a triangular configuration.

FIG. 4 illustrates another embodiment of the fence support structure which utilizes a modified modular fence panel generally indicated at 50. Specifically, fence panel 50 includes a vertical member 52, a horizontal member 54 which extends outwardly from the lower end of member 52, and a diagonal member 56 which connects the top portion of vertical member 52 with the outward end portion of horizontal member 54.

In use, the modular fence panel 50 is secured to a stress post 58 by securing the upper and lower portions of the vertical member 52 to the side of stress post 58 by use of conventional fasteners 60 such as "C" clamps or wires, so that the vertical member extends substantially parallel to and adjacent the side of stress post 58. The modular fence panel 50 is positioned substantially in the fence line by securing its lower, outer end adjacent to fence post 62, which lies within the fence line. Modular fence panel 50 is secured adjacent fence post 62 by means of a conventional fastener 64 of a type similar to fasteners 60. In this configuration, stress forces experienced by stress post 58 may be transmitted via the diagonal member 56 and the horizontal member 54 to a portion of fence post 62, thus providing support and stability for stress post 58.

Figure 5:
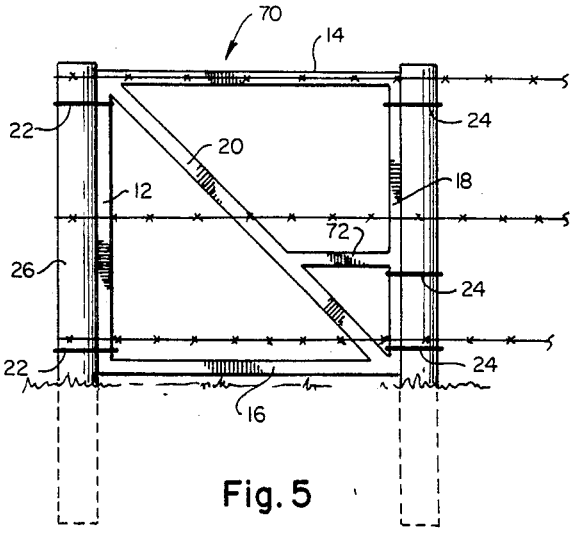
FIG. 5 is a front elevational view of still another preferred embodiment of the present invention, illustrating a fence support structure which includes a step arrangement.

FIG. 5 illustrates yet another embodiment of the present invention, wherein one or more steps are provided so as to permit climbing over the fence without destroying the integrity of the fence. In this case, the fence support structure is substantially identical to the structure of FIG. 1 with the exception that the modular fence panel, generally designated at 70, includes an additional cross member 72 which is configured to be substantially parallel to top and bottom horizontal members 14 and 16, and which is secured at one end to cross piece 20 and at its other end to the second vertical member 18. An additional fastener 24, comprising a conventional fastening means such as a "C" clamp or wire, is positioned so as to connect between and secure to the side of fence post 28 a portion of the second vertical member 18 which is adjacent to the cross member 72.

Cross member 72 comprises a step or rung which a person may utilize in climbing over the fence. Thus, the person may stabilize themselves by grasping either of the fence posts 26 or 28, or the top horizontal member 14 and they may then step on cross member 72 as they cross the fence, thereby avoiding contact with the fencing material. Although only one cross member 72 is illustrated as a step or rung in FIG. 5, it will be appreciated that other cross members could also be positioned to define additional steps by connecting them between cross member 20 and either the first vertical member 12 or the second vertical member 18 at positions which would be convenient for describing a ladder type step structure.

Figure 6:
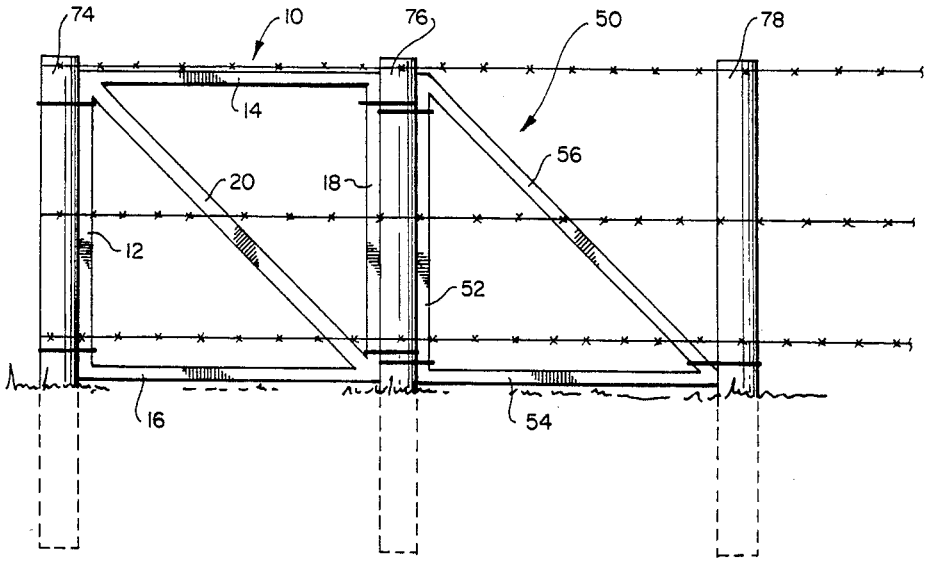
FIG. 6 is an elevational perspective view of another preferred embodiment of the present invention, illustrating use of multiple fence support structures in combination.

In order to further reduce the amount of stress experienced by any given fence post, it may be desirable to distribute stress forces among several fence posts. This can be accomplished by securing more than one modular fence panel in alignment between adjacent fence posts in the fence line, as is illustrated in FIG. 6. Particularly, FIG. 6 illustrates a first modular fence panel 10 which corresponds to the panel described with respect to FIG. 1, positioned between a stress post 74 and a fence post 76. Fence panel 10 is aligned with and secured to the fence posts in the manner previously described with respect to FIG. 1.

In addition, a second modular fence panel 50, which corresponds to the panel described with respect to FIG. 4, is positioned between fence posts 76 and 78. Modular fence panel 50 is aligned with and secured between posts 76 and 78 in the manner previously described with respect to FIG. 4. Of course, further modular fence panels could be included between additional fence posts in the fence line, in accordance with the desires of the user.

Figure 7:
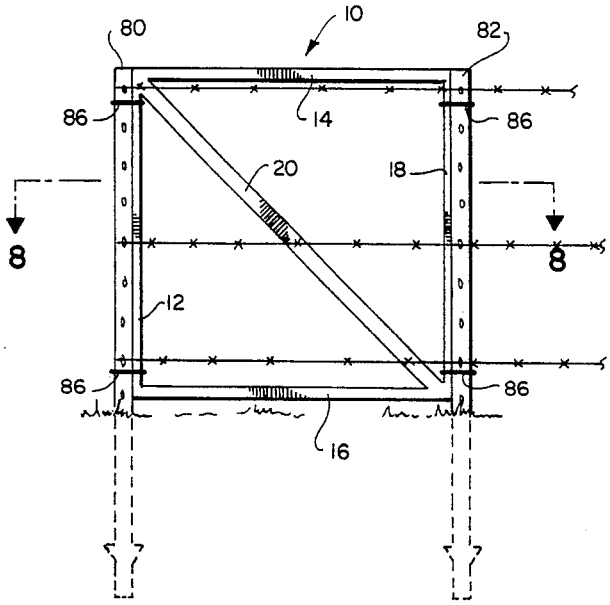
FIG. 7 is a front elevational view of still another preferred embodiment of the fence support structure, illustrating use of the support structure in conjunction with metallic fence posts.
Figure 8:
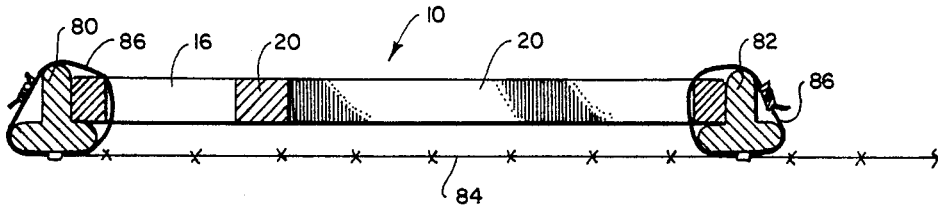
FIG. 8 is a top section view of the support structure and metallic fence post combination of FIG. 7, the view being taken along line 8—8 of FIG. 7.

FIGS. 7 and 8 illustrate a fence support structure which comprises the use of a modular fence panel 10 corresponding to the fence panel illustrated in FIG. 1, in conjunction with a pair of metal posts 80 and 82. The means by which modular fence panel 10 is secured to the metal posts 80 and 82 can best be described by reference to FIG. 8. Specifically, most conventional metal fence posts are constructed in a T configuration to provide increased structural integrity. Typically, fencing material 84, such as the barbed wire illustrated, is secured to fence posts 80 and 82 along the outer planar surface of the T cross member. Thus, modular fence panel 10 may be constructed so as to be received in mating relationship between the opposing sides of the vertical T members, and adjacent the underside of the cross member of the T. In this configuration, the fence panel is adjacent the fencing and is disposed so as to lie entirely within the fence line defined by posts 80 and 82.

As with the prior embodiments, the modular fence panel 10 is secured in position adjacent the metal posts 80 and 82 by use of conventional fasteners 86 which may comprise "C" clamps or wires, among other things, in the manner described with respect to FIG. 1.

It is noted that when the metal fence posts are constructed of steel or steel alloys, adjacent edges of aluminum fence panels appear to suffer from a reaction, causing the aluminum to deteriorate over a period of time on those surfaces adjacent steel posts 80 and 82. Therefore, it is recommended that materials other than aluminum be utilized for modular fence panels which are utilized in conjunction with steel fence posts.

Figure 9:
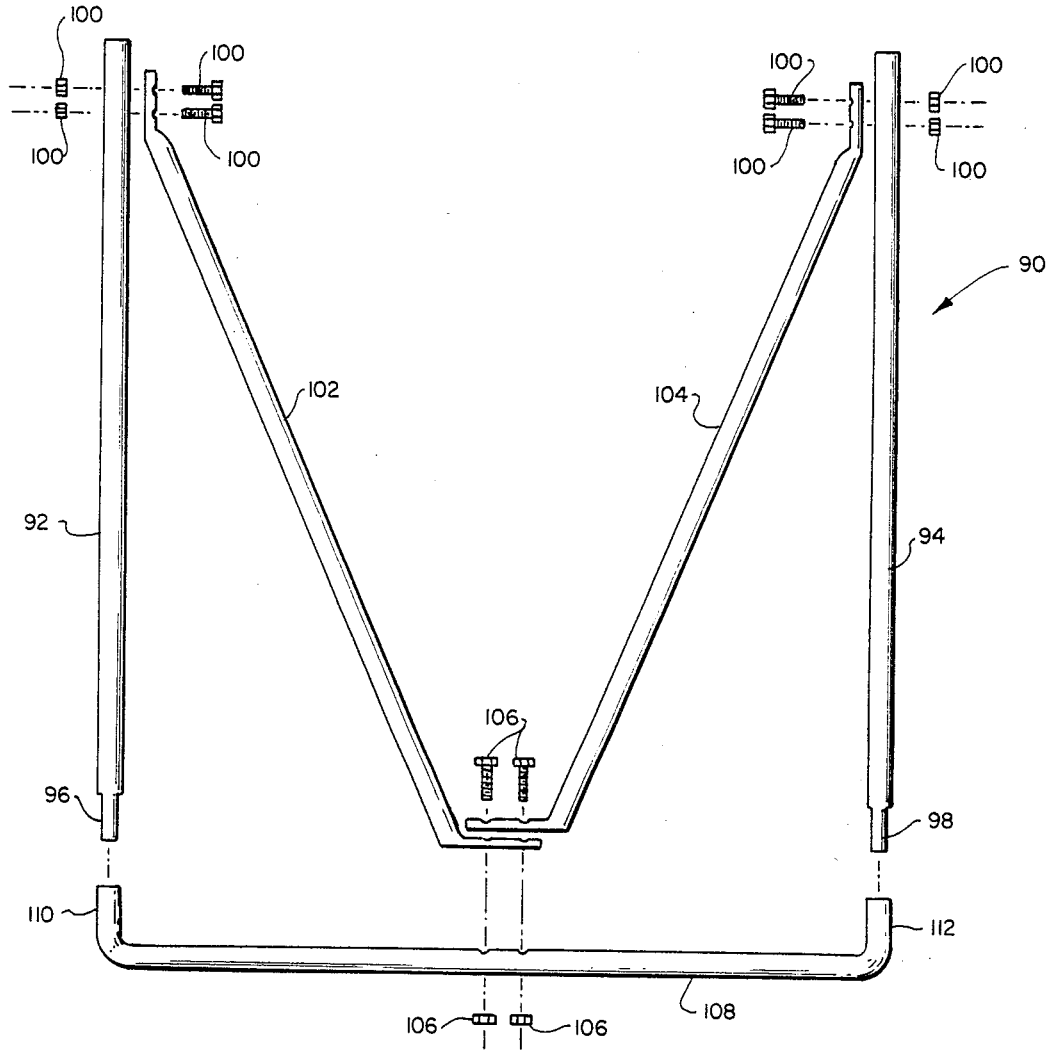
FIG. 9 is an exploded, front elevational view of still another preferred embodiment of the present invention, illustrating a fence support structure comprising component parts which are substantially linear and are easily assembled to form the support structure by use of slip joints or nut and bolt assemblies.
Figure 10:
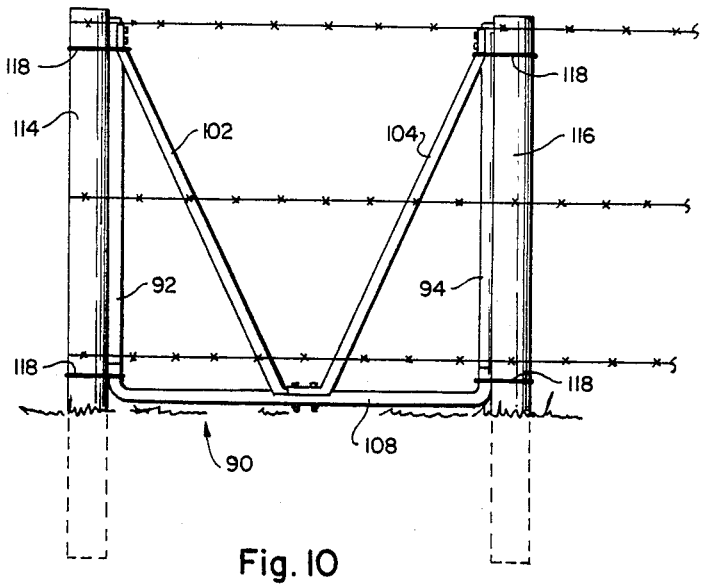
FIG. 10 is a front elevational view of the embodiment of FIG. 9, illustrated in the assembled configuration, and as positioned in conjunction with a pair of fence posts.

Although the above-described embodiments have been generally related to a prefabricated fence support structure having a unitary construction, it will be understood that those support structures could be assembled in the field by simply securing the various members through conventional means such as by use of a nut and bolt assembly, or slip joints. FIGS. 9 and 10 illustrate another preferred embodiment of the invention, which may be assembled by such use of nut and bolt assemblies, and slip joints.

Referring specifically to FIG. 9, it is seen that this embodiment of the modular fence panel, generally designated as 90, includes a pair of vertical members 92 and 94. The lower ends of vertical members 92 and 94 are configured so as to comprise reduced diameter pins 96 and 98 which may be receivably secured within a sleeve in a slip joint arrangement.

A pair of apertures (not shown) extend through the body of the vertical members 92 and 94 near their upper end. The apertures are of a size sufficient to receive nut and bolt combinations 100 therein, with the bolts additionally extending through apertures in the upper portion of diagonal support members 102 and 104.

The upper portions of diagonal support members 102 and 104 are angularly oriented with respect to the remainder of the members, and are configured so as to be received in mating relationship against the surface of the vertical members 92 and 94, so as to be secured adjacent those vertical members by means of the nut and bolt combinations 100. The lower ends of diagonal support members 102 and 104 are also angularly oriented with respect to those support members, with each angularly oriented lower end having a pair of apertures extending therethrough.

In the assembled configuration, the lower portions of diagonal support members 102 and 104 are oriented substantially perpendicular to the vertical members 92 and 94, and are received in mating relationship so as to be positioned adjacent one another with the apertures therethrough in vertical alignment. Nut and bolt combinations 106 extend through the apertures in the lower ends of diagonal support members 102 and 104, and additionally extend through corresponding apertures in a horizontal member 108, so as to secure the upper surface of the horizontal member in mating relationship adjacent the horizontal, lower surfaces of the diagonal support members 102 and 104.

The outer ends of horizontal member 108 are angularly oriented in an upward direction, forming sleeves 110 and 112 which are tubular in configuration, and which are designed to receive pins 96 and 98 in mating relationship in a manner defining slip joints.

The assembled modular fence panel 90 is illustrated in FIG. 10 where it is positioned for use to distribute stress forces between stress post 114 and fence post 116. The modular fence panel 90 is secured adjacent the sides of stress post 114 and fence post 116 by securing conventional fasteners 118 such as "C" clamps or wires about the upper and lower portions of the vertical members 92 and 94, and optionally about the upper portions of the diagonal support members 102 and 104, in the manner described previously with respect to FIGS. 1 and 2. Fence panel 90 is shown in FIG. 10 as having its horizontal member 108 disposed near the base of the fence posts; it should be understood that fence panel 90 can also be inverted and disposed with horizontal member 108 near the tops of the fence posts.

Although the embodiment illustrated in FIGS. 9 and 10 is preferably comprised of lightweight, tubular members, it can be constructed of any type of material such as wood, plastics or fiberglass, for example, which could provide the necessary structural support. One of the advantages of providing for simple assembly of the modular fence panel in the field, and for maintaining it in component structure prior to assembly, is that it is easy to store, and to transport to its location of use. For example, if the fence to be supported is some distance from a highway, it may be necessary to carry the modular fence panel by means of a horse. Clearly, it is much easier to transport the disassembled, lightweight components for later assembly than it is to carry the fully assembled fence panel.

Of course, another option which is available in connection with the use of the embodiment illustrated in FIGS. 9 and 10 is to do away with horizontal member 108 and to directly position upon the earth, or bury, the lower ends of vertical members 92 and 94 and the interconnected, lower ends of diagonal members 102 and 104. This option provides the necessary stability, while reducing the number of components which are required for assembly in the field.

Figure 11:
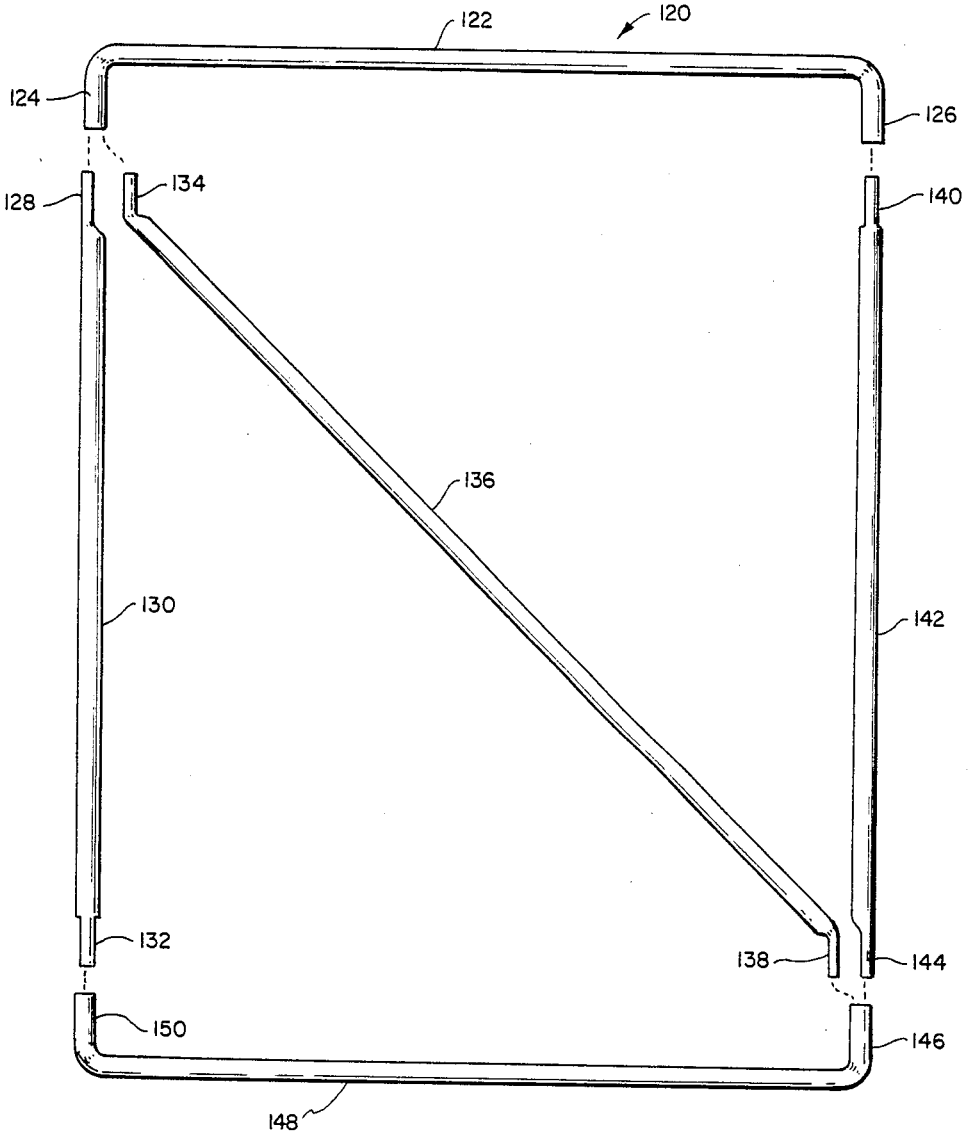
FIG. 11 is an exploded, front elevational view of another preferred embodiment of the present invention, illustrating the fence support structure configured so as to define a plurality of substantially linear component parts which may be secured together to form the fence support structure by use of slip joints.

The use of sleeve joints, without other fastening members, for assembling the modular fence panel may be described by reference to FIGS. 11 and 12. Referring specifically to FIG. 11, the individual components comprising a modular fence panel 120 similar to that described with reference to FIG. 1 are illustrated.

The modular fence panel 120 includes a top horizontal member 122 which is preferably of tubular construction. The ends of horizontal member 122 are bent so as to be oriented downwardly approximately perpendicular to the longitudinal axis of the main body of member 122, thus forming sleeves 124 and 126. Securable within sleeve 124 is the upper pin end 128 of a first vertical member 130, which is preferably of tubular construction. The lower end of member 130 is reduced in diameter so as to define a lower pin end 132, which may be utilized for connection in a sleeve joint arrangement.

The upper pin end 128 comprises a reduced diameter with respect to vertical member 130, and is positioned off center toward the outer side of the vertical member so that pin end 128 may be received in mating relationship within sleeve 124, and so that pin end 128 may also receive, in a nesting relationship, an upper pin end 134 of a diagonal member 136. Upper pin end 134 has a reduced diameter with respect to diagonal member 136, and is oriented in an angular relationship with respect to member 136 so that it is in alignment with, and may be received in mating relationship within, sleeve 124 while also being positionable within sleeve 124 in nesting relationship with upper pin end 128.

The lower end of diagonal member 136 is oriented in angular relationship with respect to the diagonal member so as to be substantially parallel with the upper pin end 134, and to define a lower pin end 138 which is substantially identical in configuration but opposed in direction with respect to the upper pin end 134.

Sleeve member 126 of the top horizontal member 122 is configured so as to receive, in mating relationship, an upper pin end 140 of a second vertical member 142. Upper pin end 140 is reduced in diameter with respect to the second vertical member 142, which is preferably of tubular construction, such that pin member 140 is securely received in mating relationship within sleeve 126. The lower end of the second vertical member 142 is reduced in diameter and offset toward the outer side of the second vertical member so as to define a lower pin end 144 which receives, in nesting relationship, and outer side of the lower pin end 138.

Lower pin ends 138 and 144 are configured so as to both be received in mating relationship within an upward directed sleeve 146 which comprises an outer end of a lower horizontal member 148. Horizontal member 148 additionally includes an upturned sleeve 150 on the opposite end from sleeve 146, with both sleeves 146 and 150 being oriented substantially in alignment and in a direction which is substantially perpendicular to the body of lower horizontal member 148. Sleeve 150 is positioned so as to be in alignment with lower pin end 132, so that the pin end 132 may be received within sleeve 150 in mating relationship.

Figure 12:
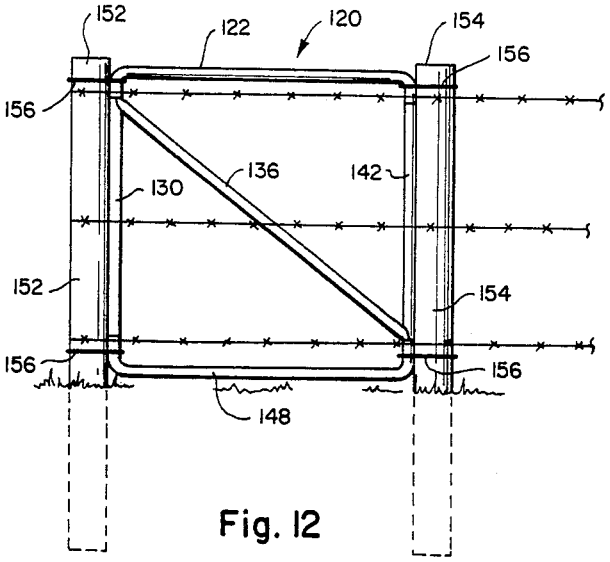
FIG. 12 is a front elevational view of the fence support structure of FIG. 11, illustrated in the assembled form and as secured between two fence posts.

By reference to FIG. 12, it is seen that the modular fence panel 120 is positioned in assembled form between stress post 152 and fence post 154 in a manner which is substantially identical to the embodiment illustrated in FIG. 1. Likewise, the modular fence panel 120 is secured in position adjacent to posts 152 and 154 by use of conventional features 156 such as "C" clamps or wires, in a manner which is substantially identical to the embodiment illustrated and described with respect to FIG. 1.

As was the case with the embodiment illustrated in FIGS. 9 and 10, one may optionally eliminate the lower horizontal member 148 from the embodiment of FIGS. 11 and 12, and position lower pin members 132, 138 and 144 directly upon the ground or bury these members within the ground adjacent the posts 152 an 154, in order to achieve the desired structural support. However, it is noted that for best performance it may be necessary to secure lower pin members 138 and 144 together by conventional means such as a nut and bolt assembly if they are to be buried within the ground without use of the lower horizontal member 148.

It is often the case that spacing between posts in a fence line is not exactly uniform, due to factors such as inexact measurement or obstructions in the ground requiring the positioning of a given post in order to place it in the ground. Even during initial construction of the fence, it may be not be possible to position the fence posts so that a snug fit can be achieved between the sides of the fence posts and the fence panel which is positioned between those posts. Thus, it becomes desirable to provide a fence panel such as those described above which is horizontally adjustable in length so that it may be snugly fitted between the sides of adjacent posts in the fence line.

Figure 13:
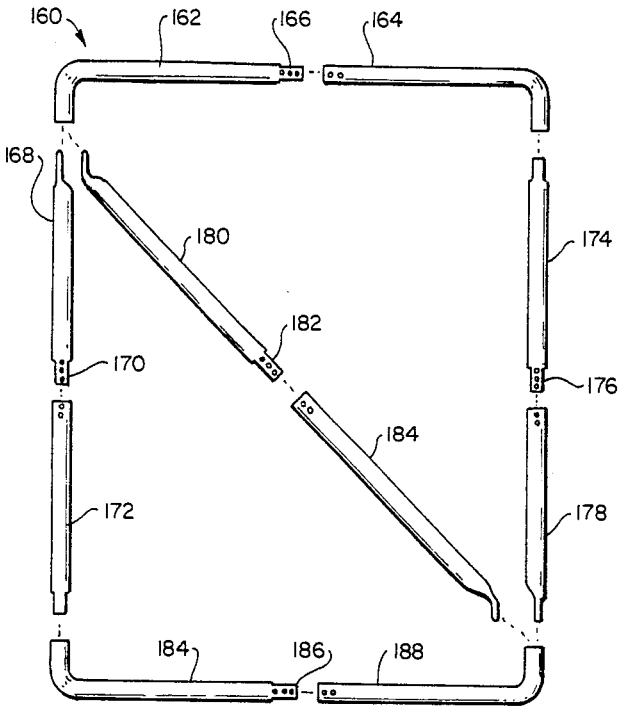
FIG. 13 is a front elevational view of another preferred embodiment of the present invention illustrating the fence support structure configured so as to comprise a plurality of substantially linear component parts which define slidably expandable support members forming the fence support structure.

FIG. 13 illustrates one embodiment of a fence panel which is expandable so as to snugly fit between and against the adjacent fence posts. Specifically, the fence panel 160 substantially corresponds in configuration to the fence panel illustrated in FIGS. 11 and 12. However, in the embodiment illustrated in FIG. 13, each of the components comprising the modular fence are comprised of a male member and a female member. For example, the upper horizontal member is comprised of a male section 162 and a female section 164. On the outward end of the male section 162 is positioned a reduced diameter pin end 166 which includes several apertures extending therein which are axially aligned along the body. Pin end 166 is configured so as to be received in mating relationship within the outward end of female section 164. Apertures extending through the side of the outward end 164 are aligned so as to correspond with the apertures in the pin end 166, thereby providing a means whereby the male section 162 and female section 164 may be secured together with a nut and bolt assembly (not shown).

By use of the aligned apertures in the adjacent ends of male section 162 and female section 164, it is possible to adjust the combined length of those sections so that they fit snugly between the sides of adjacent fence posts within the fence line. The combined lengths of the other components which comprise fence panel 160 may also be varied in a manner identical to that described above, since each of those components also comprise a male section which has a reduced diameter on its forward pin end and a female section, with apertures in both the pin end and the adjacent end of the female section. In the embodiment of FIG. 13, those other components specifically include a first vertical member comprising a male section 168 with a reduced diameter pin end 170 and a female section 172. A second vertical member including a male section 174 having a reduced diameter pin end 176 and a female section 178. A diagonal member including a male section 180 having a reduced diameter pin end 182 and a female section 184 is also included as a component. An optional lower horizontal member also comprises a male section 184 having a reduced diameter pin end 186 and a female section 188.

In use, the combined lengths of the upper and lower horizontal members are first adjusted to correctly fit between the desired fence posts in the fence line. Then the length of each of the first and second vertical members is adjusted so that the diagonal member may be adjusted to a length such that the reduced diameter, angularly oriented pin ends of the diagonal member can be properly received and secured in the ends of the horizontal members, in the manner described with respect to FIG. 11. Optionally, the first and second vertical members need not be made expandable, in which case the reduced diameter, angularly oriented pin ends of the diagonal member need to be somewhat malleable so that as the horizontal length of the fence panel is adjusted (thereby changing the angle of the diagonal member with respect to the horizontal members), the reduced diameter pin ends of the diagonal member may bend to be receivable in the ends of the horizontal members.

Figure 14:
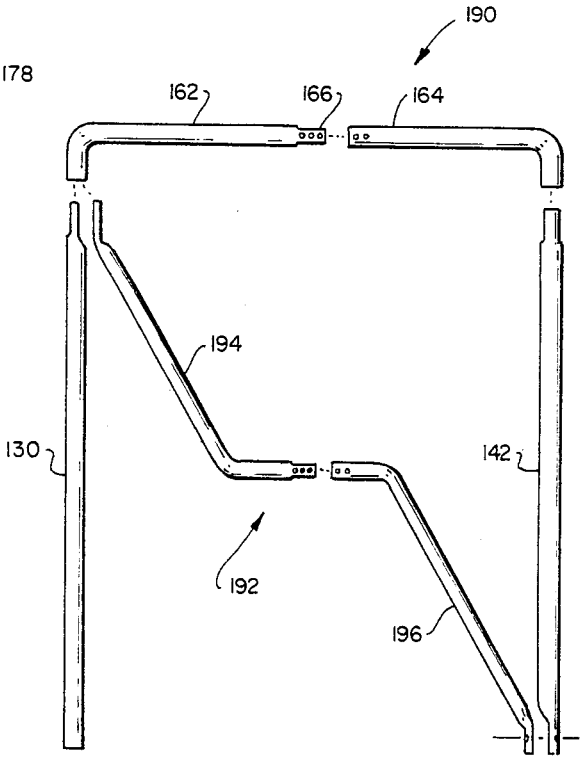
FIG. 14 is a front elevational view of still another preferred embodiment of the present invention illustrating a horizontally expandable fence support structure configured so as to comprise a plurality of component parts, some of which are slidably expandable.

Another embodiment of an expandable fence panel of the present invention is generally indicated at 190 in FIG. 14. The fence panel of FIG. 14 is configured so that the vertical members need not be expandable, and yet the horizontal members may be expandable without changing the angular relationship of the diagonal member with respect to the horizontal members. It is also noted that the lower horizontal member has been removed from the fence panel of FIG. 14, illustrating this optional configuration which is also available with respect to the other embodiments of the device such as that illustrated in FIG. 13.

The configuration of the upper horizontal member comprises a male section 162 having a reduced diameter pin end 166 and a female section 164, comprising a member which is substantially identical to the member described with respect to FIG. 13. First vertical member 130 and second vertical member 142 are substantially identical to the corresponding members in fence panel 120 of FIG. 11. If a lower horizontal member were provided in the embodiment of FIG. 14, it would be substantially identical to the lower horizontal member illustrated in FIG. 13.

The diagonal member generally indicated at 192 is configured in a manner similar to the diagonal member of fence panel 160 of FIG. 13 and may be constructed of materials such as square tubing, angle iron or channel iron. However, in the embodiment of FIG. 14, the inwardly directed end of the male section 194 of diagonal member 192 is angularly oriented with respect to the rest of the male section 194, such that the inwardly directed end thereof is substantially parallel with the upper horizontal member. Likewise, the inwardly directed end of female section 196 is also angularly oriented with respect to the body of that female section, and is positioned substantially parallel to the upper horizontal member and in alignment with the adjacent, horizontally oriented end of male section 194. Thus, as fence panel 190 is expanded horizontally, the outward ends of male section 194 and female section 196 slidably interact to maintain an unchanged angular relationship between the body portions of sections 194 and 196 with respect to the body of the upper horizontal member.

Optionally, a second diagonal member substantially identical to member 192 could be positioned in the fence panel 190 so as to interconnect between the lower portion of vertical member 130, and the downwardly directed end of the female section 164. The interconnections associated with the new diagonal member would be identical to those utilized in interconnecting the diagonal member 192 to the lower end of the second vertical member 142, and the downwardly directed end of the male section 162.

Figure 15:
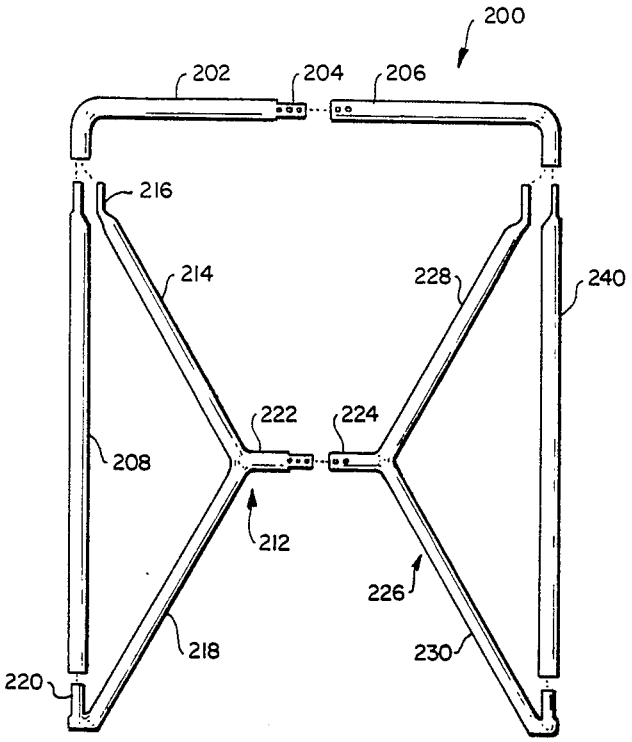
FIG. 15 is a front elevational view of another preferred embodiment of the present invention illustrating another embodiment of a horizontally expandable fence support structure.

Still another embodiment of a horizontally expandable fence panel is generally indicated at 200 in FIG. 15. Specifically, fence panel 200 includes an upper horizontal member having a male section 202 which has a reduced diameter pin end 204 and a female section 206, each of which substantially correspond to the upper horizontal member of FIG. 13. First vertical member 208 and second vertical member 240 comprise support members of unitary construction in this embodiment, and generally correspond in configuration to the vertical support members 130 and 142 of FIG. 14.

Fence panel 200 additionally includes a first central support member generally indicated at 212 which comprises an upper diagonal member 214 having a reduced diameter, angularly oriented pin end 216 which is receivable within an adjacent end of male section 202 in a mating relationship, and which is also positionable therein in nesting relationship with an upper pin end of first vertical member 208. The inwardly directed end of upper diagonal member 214 is connected to a corresponding, adjacent end of a lower diagonal member 218 which itself includes a reduced diameter lower pin end 220 which is angularly configured so as to optionally be received within a lower end of the first vertical member 208. The adjacent ends of upper diagonal member 214 and lower diagonal member 218 are interconnected to a male pin end 222 which is configured so as to be received in mating relationship with a female pin end 224 of a second central support member generally indicated at 226. A series of apertures are positioned in alignment in the side of male pin end 222 and in the side of female end 224 so that these ends may be secured in desired position by a nut and bolt assembly, in the manner previously described with respect to FIGS. 13 and 14.

Connected at their inwardly directed ends to the female end 224, are a second upper diagonal member 228 and a second lower diagonal member 230. Diagonal members 228 and 230 are configured to be substantially identical with their corresponding diagonal members 214 and 218, and are positioned in fence panel 200 so as to define a configuration of the central support member 226 which is substantially the mirror image of the upper and lower diagonal members 214 and 218, respectively, of the first central support member 212.

In use, as the horizontal length of the fence panel 200 is adjusted, the position of pin end 204 within the female section 206 is correspondingly, slidably adjusted. Likewise, the position of male pin end 222 within the female end 224 is slidably adjusted in an amount corresponding to the adjustment of the horizontal length of fence panel 200.

It will be readily appreciated that an additional horizontal base member could be utilized in the embodiment of FIG. 15, in which case the lower pin ends of lower diagonal members 218 and 230 would be directed in a downward direction, and those diagonal members and the corresponding, adjacent vertical members would be received by the ends of the horizontal base member in the manner illustrated in FIG. 11. It will also readily be appreciated that the embodiments described herein comprise only several examples of numerous other embodiments of the fence support structure which is considered to comprise the invention.

For example, a horizontally expandable fence panel could be constructed having an upper horizontal member connecting the upper portions of a first and second vertical member, and a second horizontal member positioned so as to extend between and connect desired locations other than the lower ends of the first and second vertical members. Each of the horizontal members could include a male pin end and a female end of the type described with respect to FIGS. 13–15 so as to permit adjustment of the spacing distance between the vertical members. Further stability may be added to the device by connecting a first diagonal corner member between a lower portion of the first vertical member and a location near the inwardly directed end of the adjacent, male section of the upper horizontal member. In addition, another diagonal corner member may be secured to the lower end of the second vertical member, so as to extend upward to a connection location near the inwardly directed end of the adjacent, female section of the upper horizontal member.

In still another embodiment, the two vertical members would be connected by both upper horizontal member positioned near the upper ends of the vertical members, and a lower horizontal member positioned near the lower ends of the horizontal members. Male and female connection configurations corresponding to those described with respect to FIGS. 13–15 would be provided on both the upper and lower horizontal members. An upper diagonal corner member would connect between a point in the central portion of the first vertical member and a location on the adjacent, male section of the upper horizontal member, and a lower diagonal corner member would connect between a point in the central portion of the first vertical member and a location on the adjacent, male section of the lower horizontal member. In addition, upper and lower corner diagonal members would connect between the second vertical member and the adjacent, female sections of the upper and lower horizontal members in substantially a mirror image arrangement with respect to the above-described connections of the diagonal members associated with the first vertical member.

From the foregoing description it will be appreciated that the novel fence support structure disclosed herein clearly overcomes many of the longstanding problems in the art by (1) providing a fence support structure which is easy and quick to install in a fence line, and which may optionally be utilized to retrofit an existing fence line; (2) providing a modular fence support structure which may be used with any type of fence post; (3) providing a fence support structure which is lightweight and optionally comprises a number of separate components so that it may be easily carried on horseback to areas remote from normal transportation cability; (4) providing a fence support structure which may be disposed substantially in the fence line so as to require no additional area for its use, and which additionally requires no separate support guide wires or anchoring materials; (5) providing a fence support structure which may be utilized to support numerous different types of stress posts such as corner posts, gate posts, posts on the crests of hills and posts at the bottom of valleys; (6) providing a fence support structure which can be secured to the fence line by use of conventional fastening methods; (7) providing a fence support system which may comprise a number of substantially linear component parts which may be easily assembled through use of slip joints, nut and bolt assemblies, and similar conventional assembly methods and systems; (8) providing a fence support structure which optionally can be unitary in construction, and can be prefabricated so as to be easily carried into the field for rapid application; (9) providing a fence support structure which may also be utilized for other purposes such as defining a step or ladder arrangement which may be placed at any position along the fence line, and which permits climbing over the fence without destroying the integrity of the fence; (10) providing a fence support structure which can be utilized in cooperation with other such structures to permit further distribution of the stresses from the stress post to other fence posts; and (11) providing a fence support structure which is expandable in size, thereby permitting its use both in retrofitting existing fences as well as between newly installed fence posts without the need for an exact or uniform spacing distance between fence posts.

The invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A fence support structure for use in fences having at least one fence post, the structure comprising:

distributing means, positionable between fence posts and including at least one substantially vertical member and at least one substantially diagonal member angularly oriented with respect to said vertical member, for distributing stress forces between fence posts; and securing means, including at least one member for grasping at least a portion of the surface of both said fence post and said vertical member, for securing the distributing means adjacent and between fence posts so as to permit transfer of stress forces between the fence posts.

2. A fence support structure as defined in claim 1 wherein the distributing means comprises a fence panel having structural members connected to the vertical member for transmitting stress forces to other posts.

3. A fence support structure as defined in claim 2 wherein the structural members and vertical member comprise separate members which may be assembled to form the fence panel.

4. A fence support structure as defined in claim 2 wherein the structural members and vertical member are configured so as to define a fence panel of unitary construction.

5. A fence support structure as defined in claim 2 further comprising at least one structural member which defines a step for permitting climbing over a fence without destroying the integrity of the fence.

6. A fence support structure as defined in claim 2 wherein the fence panel includes means for adjusting the physical dimensions of said fence panel.

7. A fence support structure as defined in claim 1 wherein the distributing means is disposed substantially in a fence line defined by the fence posts.

8. A fence support structure for use in fences having at least one fence post, the structure comprising:

a fence panel including at least one substantially vertical member, at least one structural member connected to the vertical member and at least one interconnecting member diagonally connected between said vertical member and said structural member, said fence panel for transmitting stress forces from said fence post to other posts;

first securing means for securing the vertical member adjacent to a first fence post along substantially the full length of the vertical member, said first securing means including at least one member for grasping a portion of the surface of both said fence post and said vertical member; and second securing means for securing a portion of the fence panel adjacent to a second fence post so as to transmit stress forces from the first fence post to the second fence post.

9. A fence support structure as defined in claim 8 wherein at least one of the structural members includes means for adjusting the physical dimensions of the fence panel.

10. A fence support structure as defined in claim 9 wherein the structural members define individual components of the fence panel, said components being removably secured together in forming the fence panel.

11. A fence support structure as defined in claim 8 wherein the structural members and vertical member are configured so as to define a fence panel of unitary construction.

12. A fence support structure as defined in claim 8 further comprising at least one structural member which defines a step for permitting climbing over a fence without destroying the integrity of the fence.

13. A fence support structure as defined in claim 8 wherein the distributing means comprises a fence panel having structural members connected to the vertical member for transmitting stress forces to other posts.

14. A fence support structure as defined in claim 8 wherein the structural members comprise at least one member positioned substantially perpendicular to the vertical member with its outwardly directed end being securable adjacent to the second fence post.

15. A fence support structure as defined in claim 14 wherein the structural members comprise at least one member positioned in angular orientation with respect to the vertical member and connected at one end to the vertical members and at the other end to at least one of the substantially perpendicular members.

16. A fence support structure as defined in claim 15 wherein a second substantially vertical member is connected to the outwardly directed end of the substantially perpendicular member.

17. A fence support structure as defined in claim 8 wherein a first fence panel is positionable between the first and second fence posts for transmitting stress forces from the first fence post to the second fence posts, and wherein additional fence panels are positionable in the fence line such that stress forces are transmitted from the second fence post through the additional fence panels to next adjacent fence posts which are connected to the second fence post through the additional fence panels.

18. A modular fence support structure for use in fences having at least one fence post, the structure comprising:

a fence panel including at least one substantially vertical member, at least one substantially horizontal member which is connected at a first end to the vertical member and at least one member positioned in angular orientation with respect to the vertical member and connected at a first end to said vertical member and at a second end to the horizontal member;

means for securing the vertical member adjacent to a first fence post along substantially the full length of the vertical member, said means for securing the vertical member including at least one member for grasping a portion of the surface of both said vertical member and said fence post; and means for securing a second end of the horizontal member adjacent to a second end of the horizontal member adjacent to a second fence post so as to transmit stress forces from the first fence post to the second fence post.

19. A fence support structure as defined in claim 18 further comprising at least one structural member which defines a step for permitting climbing over a fence without destroying the integrity of the fence.

20. A modular fence support structure as defined in claim 18 wherein the securing means comprises conventional clamping devices.

21. A modular fence support structure as defined in claim 18 wherein the securing means comprises conventional wire type tying materials.

22. A modular fence support structure as defined in claim 18 wherein the members of the fence panel are separate when the panel is unassembled, and wherein said members are interconnected when the panel is assembled through use of slip joints comprising male pin ends on selected members which are secured in adjacent female ends of interconnected members.

23. A modular fence support structure as defined in claim 22 wherein the separate members are substantially linear in configuration.

24. A modular fence support structure as defined in claim 18 wherein the members of the fence panel are separate when the panel is unassembled, and wherein said members are interconnected when the panel is assembled through use of nut and bolt assemblies.

25. A modular fence support structure as defined in claim 24 wherein the separate members are substantially linear in configuration.

26. A fence panel system for use in fences having at least one fence post, the panel system comprising:

at least one component defining a substantially vertical member in the assembled panel;

at least one component defining a substantially horizontal member in the assembled panel;

at least one component defining a substantially diagonal member which is angularly oriented with respect to the vertical member in the assembled panel;

means for interconnecting the components so as to define the assembled fence panel such that the horizontal member is connected at a first end to the vertical member, and the diagonal member and at a second end to the horizontal member; and securing means, including at least one member for grasping a portion of the surface of both said vertical member and said fence post, for securing said fence panel to said fence post.

27. A fence panel as defined in claim 26 further comprising:

means for securing the vertical member adjacent to a first fence post along substantially the full length of the vertical member; and means for securing a second end of the horizontal member adjacent to a second end of the horizontal member adjacent to a second fence post so as to transmit stress forces from the first fence post to the second fence post.

28. A fence panel as defined in claim 26 wherein the means for interconnecting the components comprises slip joints which are formed by male pin ends on selected members and female end on selected members such that the inteconnection is accomplished by securing the male pin ends in adjacent, female pin ends of the interconnected members.

29. A fence panel as defined in claim 26 wherein the means for interconnecting the components comprises conventional nut and bolt assemblies.

30. A fence panel as defined in claim 26 wherein the components are substantially linear in configuration.

31. A fence panel as defined in claim 26 wherein selected components further comprise means for adjusting the length of the components, thereby permitting adjustment of the length of the fence panel.

32. A fence panel as defined in claim 31 wherein the means for adjusting the length of the components comprises slip joints whereby a first section of the component is slidably retained at least partially within a second section of the component.

33. A fence panel as defined in claim 31 wherein the lengths of at least the horizontal members and the diagonal members are adjustable so as to permit adjustment of the length of the fence panel.

34. A fence panel as defined in claim 33 wherein the length of the vertical members are adjustable so as to permit adjustment of the physical dimensions of the fence panel.

35. A method for distributing stress forces between fence posts, the method comprising the steps of:

positioning, between a first and a second fence post a fence support structure having at least one substantially vertical member, at least one diagonal member connected to said vertical member and at least one structural member connected to the vertical member;

securing the vertical members adjacent to the first fence post along substantially the full length of the vertical member, said securing step including the step of grasping the surface of both said vertical member and said fence post with at least one securing member;

securing a portion of the structural member adjacent to the second fence post; and transmitting stress forces from the first fence post through the fence support structure to the second fence post.

36. A method for distributing stress forces as defined in claim 35 further comprising the step of adjusting the physical dimensions of the fence support structure to permit positioning of the fence support structure between the first and second fence posts.

37. A method for distributing stress forces as defined in claim 35 wherein, prior to the step of positioning the fence support structure, the method further comprises the step of assembling the fence support structure by interconnecting a plurality of separate components comprising the vertical and structural members.

38. A method for distributing stress forces as defined in claim 35 wherein the step of positioning, between a first and a second fence post, a fence support structure comprises the step of positioning the fence support structure between the first and second fence posts such that the positioned fence support structure is disposed substantially within a fence line defined by the first and second fence posts.

* * * * *